US005216954A

United States Patent [19]

Thompson

[11] Patent Number: 5,216,954

[45] Date of Patent: Jun. 8, 1993

[54] MULTI-SECTION MOUNTABLE SLEEVES AND METHODS FOR MOUNTING AND DISMOUNTING SAME

[76] Inventor: William L. Thompson, 5004 NW. Lincoln, Vancouver, Wash. 98663

[21] Appl. No.: 782,380

[22] Filed: Oct. 24, 1991

[51] Int. Cl.[5] ..... B41F 13/10

[52] U.S. Cl. ..... 101/375; 492/45

[58] Field of Search ..... 101/375; 29/129, 129.5, 29/125, 132, 113 R; 156/215, 281; 118/234, 244, DIG. 15

[56] References Cited

U.S. PATENT DOCUMENTS

| | | | |
|---|---|---|---|
| Re. 32,228 | 8/1986 | van der Velden | 156/215 |
| 32,954 | 7/1861 | Allender | 29/129 |
| 2,287,122 | 6/1942 | Norris | 204/11 |
| 2,616,633 | 11/1952 | Reynolds | 29/129 |
| 3,023,995 | 3/1962 | Hopkins | 29/129 |
| 3,035,331 | 5/1962 | Wieman | 29/129 |
| 3,146,709 | 9/1964 | Bass et al. | 101/375 |
| 3,978,254 | 8/1976 | Hoexter et al. | 428/36 |
| 3,982,312 | 9/1976 | Finzer | 29/130 |
| 4,119,032 | 10/1978 | Hollis | 101/216 |
| 4,133,813 | 3/1979 | Julian | 101/382 R |
| 4,144,812 | 3/1979 | Julian | 101/382 R |
| 4,381,709 | 5/1983 | Katz | 101/375 |
| 4,491,082 | 1/1985 | Barch et al. | 101/375 |
| 4,503,769 | 3/1985 | Anderson | 101/153 |
| 4,903,597 | 2/1990 | Hoage et al. | 101/401 |
| 4,949,445 | 8/1990 | Van Der Meulen | 29/117 |
| 4,979,278 | 12/1990 | Thompson | 29/234 |
| 5,046,231 | 9/1991 | Thompson | 29/426 |
| 5,062,193 | 11/1991 | Thompson | 29/426 |
| 5,072,504 | 12/1991 | Thompson | 29/426 |

FOREIGN PATENT DOCUMENTS

| | | | |
|---|---|---|---|
| 355111 | 12/1920 | Fed. Rep. of Germany | 101/378 |
| 354954 | 7/1921 | Fed. Rep. of Germany | 101/375 |
| 2027200 | 1/1979 | Fed. Rep. of Germany | 101/375 |
| 0008264 | 1/1981 | Japan | 101/375 |
| 1071457 | 2/1984 | U.S.S.R. | 101/375 |
| 929081 | 6/1963 | United Kingdom | 101/375 |
| 1581232 | 1/1976 | United Kingdom . | |
| 2031801 | 4/1980 | United Kingdom . | |

*Primary Examiner*—Eugene H. Eickholt

*Attorney, Agent, or Firm*—Marger, Johnson, McCollom & Stolowitz, Inc.

[57] ABSTRACT

The cylindrically-shaped multi-section mountable printing sleeve of this invention is readily axially mountable on and dismountable from a complementary plate cylinder. This sleeve comprises a multi-section cylindrically-shaped sleeve having substantially cylindrically-shaped wall surfaces of substantially constant cross-sectional inner and outer diameter. The multi-section cylindrically-shaped sleeve can include a plurality of complementary tapered sleeve sections, preferably a pair of interconnected inner and outer tapered sleeve sections. The multi-section printing sleeve can also include at least one tapered annular section, preferably at least one tapered annular section connected to a cylindrical outer printing sleeve section.

21 Claims, 2 Drawing Sheets

MULTI-SECTION MOUNTABLE SLEEVES AND METHODS FOR MOUNTING AND DISMOUNTING SAME

BACKGROUND OF THE INVENTION

This invention relates to multi-section sleeves which are readily mountable onto and dismountable from cylinders, and to methods for mounting and dismounting these multi-section sleeves.

One prior art segment in which sleeves are mounting onto and dismounted from cylinders is in flexographic printing. In early printing operations, flexible printing plates were mounted onto the outer surface of a plate cylinder. These plates were used for printing of ink images onto a printing medium. Typically, the back of the plates was adhered directly to the plate cylinder. Since these plates were not readily interchangeable from one cylinder to another, the use of a multiplicity of plate cylinders to perform a multiplicity of jobs were required. This presented severe storage and cost problems to the end user.

Therefore, in an effort to overcome this problem, unitary printing sleeves were developed which were mountable onto and dismountable from the plate cylinders. Compressed gas, generally compressed air, passing in a substantially radial direction from holes located within the plate cylinders, was used to expand the unitary sleeve to a limited extent for facilitating the mounting and dismounting operations.

The first patent to describe this mode of mounting and dismounting of a printing sleeve was described in U.S. Pat. No. 3,146,709. In that patent, a "wound" unitary sleeve, i.e., a helically wound paper sleeve, was fitted onto a hollow cylinder. The sleeve was used as a carrier roll for rubber printing plates attached thereto. Air pressure was radially applied through the holes in the external surface of the cylinder for limited expansion of the sleeve. The sleeve was then axially mounted onto the cylinder by moving the cylinder to an upright position and filling the internal chamber of the cylinder with compressed air. As the sleeve was moved over the upper end of the cylinder, the exiting air expanded the sleeve and a lubricating air film was interposed between the inner sleeve and the outer cylinder. This air film permitted the axial movement of the sleeve to a position about the cylinder. When the sleeve was in such a position, the air flow was terminated, and the sleeve contracted in place about the cylinder. One problem with this sleeve is that today's quality requirements mandate surface tolerances which cannot be maintained by this sleeve. Also, these sleeves are very fragile and printers can't cut the plates located thereon or even remove them when modern adhesives are used.

In order to overcome the problems inherent in the U.S. Pat. No. 3,146,709 wound printing sleeve, U.S. Pat. No. 3,978,254 has provided a mechanically adhered wound unitary printing sleeve in which three layers of adhesive tape are helically wound about a mandrel to form a carrier sleeve, with two of the helixes being wound at the same angle and the remaining helix being wound at a different angle. The convolution of the helixes are said to impart some degree of strength, rigidity and leakage protection to the printing sleeve. Furthermore, the outer surface of the U.S. Pat. No. 3,978,254 wound sleeve has a plurality of surface irregularities formed therein and is therefore not "round" to the extent required by the flexographic printing industry. These carrier sleeves are made of a flexible, thin tape material which provides a minimum of structural integrity which exhibit minimal strength and durability properties. Moreover, as the printing plates are adhered to the printing sleeves they may not be moved from one position to another as they are aligned on the sleeves surface. In order to trim material on the plate from the sleeve surface, they must be cut with a sharp instrument such as a knife. The synthetic plastic tape used to form the above-described sleeve cannot withstand even the minor cutting action required in positioning of the printing plates. Finally, with high speed printing presses of today, these sleeves can slip.

Dimensional stability is a problem in printing applications requiring that the outer surface of a printing sleeve structure have a true cylindrical shape. For example, in the flexographic printing industry, the outer printing surface must accurately conform to a uniformly constant, cylindrical outer shape in order to accurately imprint a print image onto a printing medium. Many of these prior art printing sleeves do not meet these requisite tolerance levels.

U.S. Pat. No. 2,287,122 is another type of printing sleeve which is made of a metallic material. As in the case of some wound sleeves, metallic sleeves are not readily expandable and therefore must have a wall thickness which is be quite thin, i.e., thicknesses of up to only about 0.005", in order to be capable of undergoing the limited expansion required in mounting printing sleeves. As indicated above, this minimum thickness level required of metallic sleeves is a problem in instance where thicker sleeves are required. Moreover, metallic printing sleeves are not durable and are susceptible to damage. For instance, kinks are easily formed in these sleeves during mounting, dismounting or storage operations.

U.S. Pat. Nos. 4,144,812, 4,144,813, UK 1,581,232, UK 2,031,801 and EPA 181,726 relate to non-cylindrical unitary printing sleeves and complementary associated air-assisted printing rolls designed in a tapered or stepped-transition configuration. In these systems, the change in the sleeve and printing roll diameter from one end to the other is progressive, i.e., increasing or decreasing according to the direction one is moving along the printing sleeve or roll. The printing roll comprises complementary outer surface to the above printing sleeve having a diameter at one longitudinal end greater than the other longitudinal end. The printing sleeve has an inner surface designed to form an interference fit with the outer surface of the printing roll only at the designated working position, and not along the entire axial uniform cross-sectional extent of the tapered sleeve. In this technology, the end user cannot employ its existing standard constant diameter cylinders, but must instead purchase new tapered print rollers and complementary tapered sleeves.

U.S. Pat. No. 4,903,597, which is owned by the common assignee of this patent application, is directed to a unitary, cylindrically-shaped printing sleeve axially mountable on and dismountable from a complementary cylindrically-shaped plate cylinder, and is incorporated herein by reference. This sleeve can be fabricated of a high strength material having a wall thickness of a least about 0.15 inches. Over a typical course of repeat circumferences for wide web flexographic printing use, i.e., 15–30 inch repeat circumference, plate cylinders would have 60 different circumferences at one-quarter inch intervals. When the print sleeves of U.S. Pat. No. 4,903,597 are employed in a similar application, the required number of plate cylinders are reduced by 50%. The remaining 50% of repeat circumferences are obtained by using the print sleeves whose cost is only a fraction of the cost of a plate cylinder.

In all the above printing sleeve applications air-assisted cylinders are required in order to mount or dismount printing sleeves. Typical or standard printing cylinders must be modified to be air-assisted. These air-assisted cylinders typically employ compressed air which may present safety problems. Prior to the use of sleeves, large inventories of premounted cylinders were maintained which is extremely costly. Additional expenses are incurred when standard cylinders are physically modified to accept internal air mounted sleeves. This modification to plate cylinders can be avoided when external air systems are employed. If external air-assisted structures are needed, one can use systems such as those set forth in U.S. Pat. No. 4,979,278 issued on Dec. 25, 1990, U.S. Pat. No. 5,046,231 issued Sep. 10, 1991, U.S. Pat. No. 5,062,193 issued Nov. 5, 1991, and U.S. Patent Application, Ser. No. 07/474,520 filed on Feb. 1, 1990, which are incorporated herein by reference, and invented by the inventor of this patent application and assigned to the assignee of this patent application, can be employed. In either case, these additional costs must be paid for by the end user and ultimately their customers.

Therefore, a need exists for a cylindrically-shaped sleeve which can be easily frictionally mounted onto or dismounted from conventional cylindrically-shaped cylinders, without incurring the cost of purchasing tapered print rollers or modifying present inventories of cylinders.

SUMMARY OF THE INVENTION

This invention relates to a multi-section sleeve, such as a multisection print sleeve, having a cylindrical inner wall surface for mounting onto a constant diameter cylinder and having a cylindrical outer wall surface. The subject multi-section sleeve meets the aforementioned needs, overcomes the above-described problems associated with prior art sleeves, and minimizes the inventory of cylinders and sleeves required by an end user.

More specifically, the cylindrically-shaped multi-section mountable printing sleeve of this invention is readily axially mountable on and dismountable from a complementary plate cylinder. This sleeve comprises a multi-section cylindrically-shaped sleeve having substantially cylindrically-shaped wall surfaces of substantially constant cross-sectional inner and outer diameter. The multi-section cylindrically-shaped sleeve can include a plurality of complementary tapered sleeve sections, preferably a pair of interconnected inner and outer tapered sleeve sections.

Typically, the complementary tapered sleeve sections of this multi-section mountable sleeve are fabricated of a polymeric material. The printing sleeve can also comprise a laminate structure.

In one form of this invention, the multi-section printing sleeve includes at least one tapered annular section, preferably at least one tapered annular section connected to a cylindrical outer printing sleeve section. At least one tapered annular section can also be located between a cylindrical outer printing sleeve section and an inner tapered printing sleeve section, and is preferably connected to the outer printing sleeve section.

In another aspect of the present invention, the inner tapered printing sleeve section of the printing sleeve has a substantially cylindrically-shaped inner wall section, a tapered outer wall section, and a pair of first and second ends, and the outer sleeve section of the printing sleeve has a substantially cylindrically-shaped outer wall section, a tapered inner wall section, and a pair of first and second ends. Preferably, the outer diameter of first end of the inner printing sleeve is less than the outer diameter of second end of the first printing sleeve, and the outer diameter of first end of the second printing sleeve is greater than the outer diameter of second end of the second printing sleeve. More specifically, the outer diameter of the first and second ends of the first printing sleeve is fixed, and the outer diameter of the first and seconds ends of the second printing sleeve is varied depending on the requisite diameter of the printing sleeve.

The outer sleeve section of the printing sleeve is preferably axially mounted onto the inner sleeve section of the printing sleeve without air assistance. The printing sleeve can also further comprises means for positioning said complementary tapered printing sleeve sections in a fixed aligned relationship with respect to each other, preferably wherein the means for positioning said complementary tapered printing sleeve sections comprises at least one locating pin and at least one locating slot.

A method is also provided for axially mounting a cylindrical-shaped multi-section printing sleeve onto a complementary cylindrically-shaped plate cylinder and for dismounting said printing sleeve from said plate cylinder. The method comprises providing the cylindrically-shaped multi-section printing sleeve described above which comprises inner and outer complementary tapered printing sleeve sections, an inner tapered printing sleeve section including an inner wall section having a substantially constant diameter and a tapered outer wall, and an outer tapered printing sleeve section including an outer wall section having a substantially constant diameter and an tapered inner wall which is complementary to the tapered outer wall of said inner printing sleeve section. The inner tapered printing sleeve section is then axially mounted onto the plate cylinder to form a minimum interference fit between the plate cylinder and the inner printing sleeve section, respectively. Next, the outer tapered printing sleeve section is axially mounted onto the inner printing sleeve section to form an interference fit between said outer printing sleeve section and said inner printing sleeve section, respectively. As stated above, this later mounting step can be effected without the assistance of pressured air either from within the interstices of the plate cylinder, or from an external source of compressed air.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Figure 1:
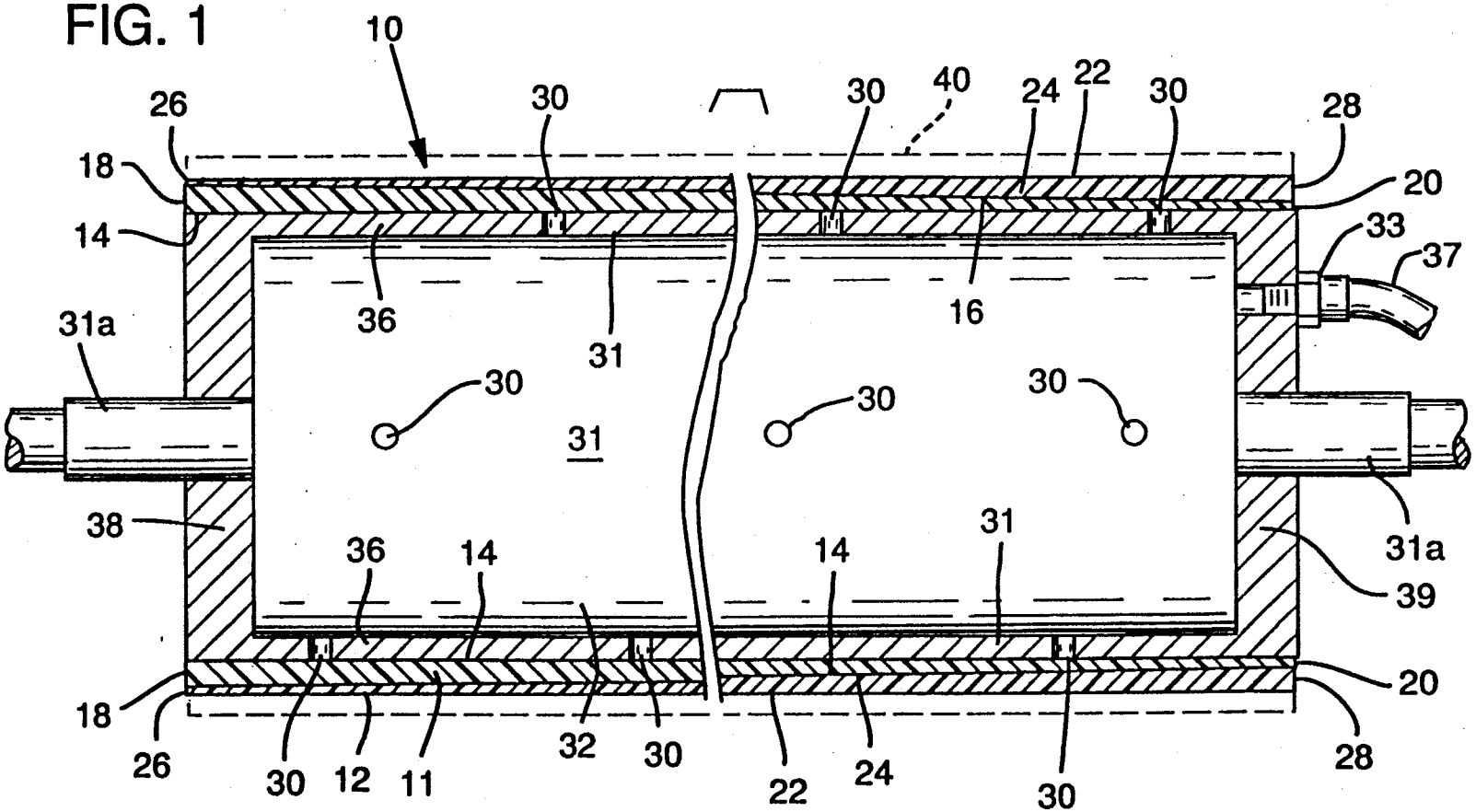
FIG. 1 is a sectional view of a fully-assembled, two-section printing sleeve of the present invention which mounted on an air-assisted plate cylinder.

Referring now to FIGS. 1, a cylindrically-shaped multi-section printing sleeve 10 is depicted which is mounted onto the outer wall 31 of an air-assisted plate cylinder 32. Multi-section printing sleeve 10 comprises respective complementary inner and outer sleeve sections 11 and 12 which together define outer and inner surfaces which are substantially cylindrical in shape, the printing sleeve 10 defining a substantially cylindrical inner chamber.

Figure 2:
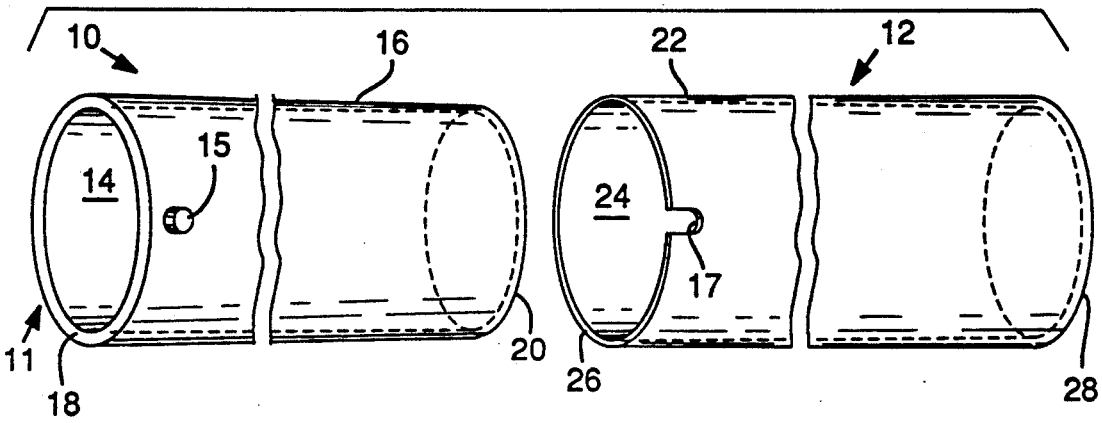
FIG. 2 is an exploded perspective view of a two-section printing sleeve shown in unassembled form, including an alignment assembly.

Referring to FIGS. 1 and 2, the inner sleeve section 11 of multi-section sleeve 10 has an inner wall section 14 having a substantially constant diameter, a tapered outer wall section 16, and a pair of first and second ends 18 and 20. The outer diameter of first end 18 is greater than the outer diameter of second end 20. A locating pin 15 is joined to inner sleeve section 11 at a point close to the first end 18 of thereof. The outer sleeve section 12 of multi-section sleeve 10 has a outer wall section 22 having a substantially constant diameter, a tapered inner wall section 24, and a pair of first and second ends 26 and 28. The outer diameter of first end 26 is less than the outer diameter of second end 28. Outer sleeve section 12 also a locating slot 17 in the second end 26. In the assembly of multi-section printing sleeve 10, inner sleeve section 11 and outer sleeve section 12 are moved into interlocking engagement with each other so that locating pin 15 is positioned within locating slot 17. In this way, the complementary sleeve sections 11 and 12 are in a fixed aligned relationship with respect to each other. To disengage the sections of the printing sleeve 10, sections 11 and 12 are physically moved apart from each other.

Figure 3:
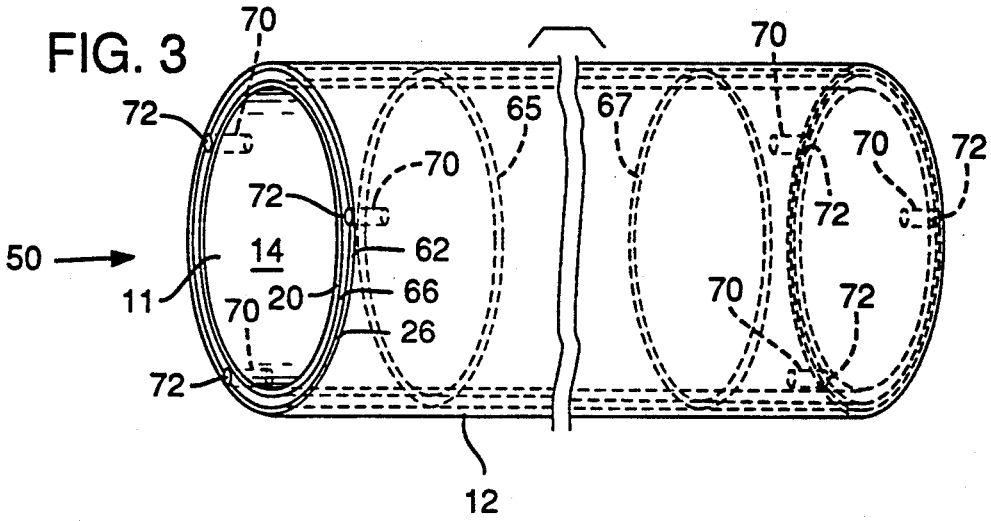
FIG. 3 is a perspective view of a multi-section printing sleeve shown in assembled form.
Figure 4:
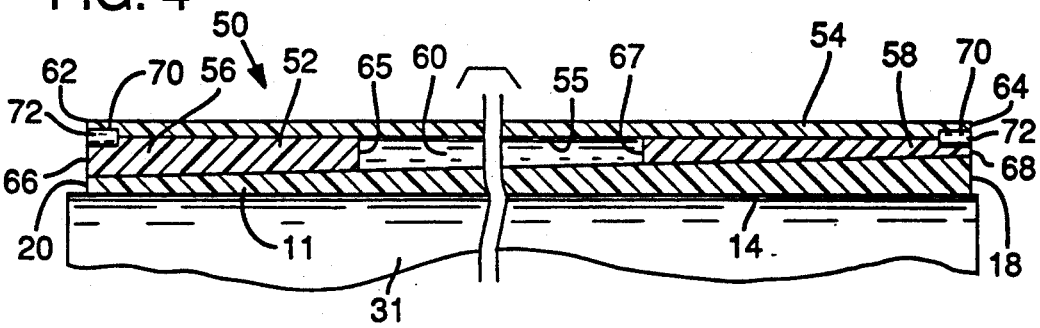
FIG. 4 is a sectional view of the multi-section printing sleeve of FIG. 3.

An alternative multi-section sleeve configuration, denoted 50, is depicted in FIGS. 3 and 4. The inner tapered sleeve section 11 is similar in design to section 11 of multi-section sleeve 10. The outer sleeve section 52 comprises a cylindrically-shaped printing sleeve section 54, which is similar in design to sleeve 10 of U.S. Pat. No. 4,903,597, and has a pair of tapered sleeve spacer sections 56 and 58 attached at its respective first and second ends 62 and 64. Tapered sleeve spacer sections 56 and 58, having respective outer ends 66 and 68, and inner ends 65 and 67 which together define an annular chamber 60. Bores 70 are drilled into the ends 62 and 64 of sleeve 54, and ends 66 and 68 of tapered sleeve spacer sections 56 and 58, so that a cylindrical opening is formed for pin 72 to be fitted therewithin for maintaining the attachment of tapered sleeve spacer section 56 and 58 to sleeve 54. As further means of connecting tapered sleeve spacer section 56 and 58 to sleeve 54, a high strength polymeric adhesive material can also be applied to the outer surface of tapered sleeve spacer section 56 and 58, and the complementary inner surface 55 of outer sleeve 54. The size of first and second ends 66 and 68 of tapered sleeve spacer sections 56 and 58 are adjusted so that the total size of ends 66 and 20 is equal to the total size of ends 68 and 18. In this way, the uniform diameter of the multi-section sleeve 50 can be maintained.

Typically, sleeve section 11 remains in place during use on a given plate cylinder and does not have to be removed when a different print plate 40 is required or a different repeat circumference is needed. Sleeve section 12 will serve as a support for the application of printing plates, preferably flexographic printing plates 40 (see FIG. 1 in phantom), which are generally made of a flexible polymeric material. Any suitable indicia for printing onto a printing medium may be provided on these printing plates. If a different printing plate is required, only sleeve section 12 is replaced. The outer sleeve section 12 dimension can be modified over the full range of printing repeat requirements. This can be accomplished without changing any of the printing plate cylinders, although the gearing used to operate the print cylinders will require changing to the proper pitch height or repeat circumference.

The inner wall 14 of the multi-section printing sleeve 10 and the outer surface of plate cylinder 32 have a different constant diameter. The outer wall 31 of the cylinder 32 has a slightly larger diameter than the inner wall 14 so that the sleeve will firmly frictionally fit onto the cylinder. Stated another way, multi-section printing sleeve 10 is mounted onto plate cylinder 32 so that an interference fit is formed therebetween. The plate cylinder 32 depicted in FIG. 1 is hollow and forms a cylindrical chamber therewithin which is used as a compressed air chamber. Cylinder 32 may also be fabricated of a solid construction and used in conjunction with external air. The cylinder 32 comprises a cylindrical tube 36 fitted with airtight end plates 38 and 39. A plurality of spaced-apart, radially-extending apertures 30 are provided in the tube 36 through which air from the inner chamber may pass for expanding the sleeve 10 during mounting and dismounting operations. Air is introduced into the chamber through air hose 37. Trunnions 31*a* are provided for supporting cylinder 32. A coupling element 33 is disposed within endplate 39 and provides a means for connecting air hose 37 to cylinder 32 for introducing compressed air to the cylinder chamber.

The cylindrically-shaped multi-section printing sleeve 10 typically is formed of a pair of complementary structural sleeve sections 11 and 12, preferably formed of a polymeric material. Various processes can be employed to produce the structural sleeve sections 11 and 12 such as by pouring a polymeric material into complementary fabrication molds, by injection molding using a RTM molding technique, or by formation methods to produce polymeric laminates, such as the laminate formation method set forth in U.S. Pat. No. 4,903,597. The tapered inner wall section 24 of outer sleeve section 12 can be formed as a laminate using a tapered, non-cylindrical laminate mold. The complementary tapered outer wall section 16 of inner sleeve section 11 can be fabricated by grinding the outer wall section of a cylindrical laminate sleeve of constant outside diameter. Although various polymers can be used to produce multi-section sleeves 10, polymers such as polyurethanes and polyepoxides are preferred.

The properties of printing sleeves 10 and 50 of the present invention with respect to strength, durability, expansion air pressure, physical properties (such as flexural modulus and stiffness), wall thickness, materials of construction, dimensional tolerance, interference fit, and the like, are similar to that which is described in U.S. Pat. No. 4,903,597, which is incorporated herein by reference.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A cylindrically-shaped multi-section sleeve, readily axially mountable on and dismountable from a complementary cylindrically-shaped plate cylinder having a constant outer diameter, which comprises a multi-section cylindrically-shaped sleeve having substantially cylindrically-shaped wall surfaces of substantially constant cross-sectional inner and outer diameter, said multi-section cylindrically-shaped sleeve including a plurality of complementary tapered sleeve sections.

2. The sleeve of claim 1, which comprises a pair of interconnected inner and outer tapered sleeve sections.

3. The sleeve of claim 1, wherein said complementary tapered sleeve sections are fabricated of a polymeric material.

4. The sleeve of claim 2, which further includes at least one tapered annular section.

5. The sleeve of claim 4, wherein the outer sleeve section is cylindrically-shaped, and said annular section is connected to said cylindrically-shaped outer sleeve section.

6. The sleeve of claim 5, wherein at least one annular section is located between said inner tapered sleeve section and said cylindrically-shaped outer sleeve section.

7. The sleeve of claim 6, wherein said annular section is connected to said outer cylindrically-shaped sleeve section.

8. The sleeve of claim 2, wherein the inner tapered sleeve section of the sleeve has a substantially cylindrically-shaped inner wall section, a tapered outer wall section, and a pair of first and second ends, and the outer sleeve section of the sleeve has a substantially cylindrically-shaped outer wall section, a tapered inner wall section, and a pair of first and second ends.

9. The sleeve of claim 8, wherein the outer diameter of first end of the inner sleeve section is less than the outer diameter of second end of the first sleeve section, and the outer diameter of first end of the second sleeve section is greater than the outer diameter of second end of the second sleeve section.

10. The sleeve of claim 9, wherein the outer diameter of the first and second ends of the first sleeve section is fixed, and the outer diameter of the first and seconds ends of the second sleeve section is varied depending on the requisite diameter of the sleeve.

11. The sleeve of claim 1, wherein the outer sleeve section of the sleeve is axially mounted onto the inner sleeve section of the sleeve without air assistance.

12. The sleeve of claim 1, which comprises a laminate structure.

13. The sleeve of claim 1, which further comprises means for positioning said complementary tapered sleeve sections in a fixed aligned relationship with respect to each other.

14. The sleeve of claim 13, wherein said means for positioning said complementary tapered sleeve sections comprises at least one locating pin and at least one locating slot.

15. A multi-section, cylindrically-shaped sleeve, readily axially mountable on and dismountable from a complementary cylindrically-shaped plate cylinder, which comprises a multi-section sleeve cylindrically-shaped wall surfaces of substantially constant cross-sectional inner and outer diameter which includes complementary inner and outer tapered sleeve sections, the inner tapered sleeve section having a substantially cylindrically-shaped inner wall section, a tapered outer wall section, and a pair of first and second ends, the outer sleeve section of the sleeve having a substantially cylindrically-shaped outer wall section, a tapered inner wall section, and a pair of first and second ends.

16. The sleeve of claim 15, wherein the outer diameter of first end of the inner sleeve section is less than the outer diameter of second end of the first sleeve section, and the outer diameter of first end of the second sleeve section is greater than the outer diameter of second end of the second sleeve section.

17. The sleeve of claim 15, wherein said inner tapered sleeve section comprises at least one annular section which engages the outer surface of said complementary plate cylinder at a plurality of locations.

18. The sleeve of claim 15, which further includes at least one tapered annular section.

19. The sleeve of claim 18, wherein the outer sleeve section is cylindrically-shaped, and said annular section is connected to said cylindrically-shaped outer sleeve section.

20. The sleeve of claim 15, wherein at least one annular section is located between said inner tapered sleeve section and said cylindrically-shaped outer sleeve section.

21. The sleeve of claim 15, which further comprises means for positioning said complementary tapered sleeve sections in a fixed aligned relationship with respect to each other.

* * * * *